US008695960B2

(12) United States Patent
Mandel et al.

(10) Patent No.: US 8,695,960 B2
(45) Date of Patent: Apr. 15, 2014

(54) AUTOMATIC MEDIA LOADING AND UNLOADING SYSTEM FOR PRODUCING DIMENSIONAL DOCUMENTS

(75) Inventors: Barry P. Mandel, Fairport, NY (US); William W. Nowak, Webster, NY (US); Robert A. Clark, Williamson, NY (US); Linn C. Hoover, Webster, NY (US); Thomas C. Hollar, Penfield, NY (US); Peter J. Knausdorf, Henrietta, NY (US); Thomas J. Wyble, Williamson, NY (US); Kathleen A. Feinberg, Rochester, NY (US); Ming Yang, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 187 days.

(21) Appl. No.: 13/331,501

(22) Filed: Dec. 20, 2011

(65) Prior Publication Data

US 2013/0156484 A1 Jun. 20, 2013

(51) Int. Cl.
*B65H 3/44* (2006.01)

(52) U.S. Cl.
USPC ..... 271/9.08; 271/9.07; 271/90

(58) Field of Classification Search
USPC ..... 270/30.09, 30.01; 271/9.07, 9.08, 90, 271/107; 414/416.03
See application file for complete search history.

(56) References Cited

U.S. PATENT DOCUMENTS

| | | | | |
|---|---|---|---|---|
| 4,483,527 | A * | 11/1984 | Hashimoto et al. | 271/5 |
| 5,809,360 | A * | 9/1998 | Blake et al. | 396/517 |
| 7,229,241 | B2 * | 6/2007 | Solomon et al. | 414/416.07 |
| 2012/0175836 | A1 * | 7/2012 | Meier et al. | 271/3.19 |

* cited by examiner

*Primary Examiner* — Michael McCullough
*Assistant Examiner* — Howard Sanders
(74) *Attorney, Agent, or Firm* — Alix, Yale & Ristas, LLP

(57) ABSTRACT

A media loading and unloading system, for use with a media cutting system having a cutting table and cutting apparatus to cut or score media held on a surface of the cutting table, includes an elevator assembly and a bi-directional transport system. The elevator assembly includes a drive and multiple vertically displaced bins that are vertically movable up and down by the drive. The bi-directional transport system transports media in a lateral feed direction from the elevator assembly to the cutting table surface and removes media from the cutting table surface in a lateral direction opposite to the feed direction to the elevator assembly.

19 Claims, 15 Drawing Sheets

AUTOMATIC MEDIA LOADING AND UNLOADING SYSTEM FOR PRODUCING DIMENSIONAL DOCUMENTS

BACKGROUND

This disclosure relates generally to apparatus for producing documents. More particularly, the present disclosure relates to apparatus for producing dimensional documents.

In one conventional method of producing dimensional documents having custom printing and/or images, the printing and/or images are printed on stock, a two-dimensional document is then cut from the stock using a flat or rotary die system, and the two-dimensional document is then folded and glued to form a 3-D dimensional document. In this method, the printing may be performed on a thin stock that is later glued to a heavier weight stock to provide greater stability and strength.

In another conventional method, the printing and/or images are printed on pre-cut stock to form a two-dimensional document, and the two-dimensional document is then folded and glued to form a 3-D dimensional document. In this method, the printing is generally performed on a heavier weight stock, requiring printing apparatus that can handle such stock. In addition, the pre-cut stock is generally more expensive, must be inventoried, and this method limits the flexibility of the printer in terms of the sizes and designs that can be produced.

Conventional systems for producing dimensional documents, such as megaphones, small boxes, photo-geo-domes, and the like, having custom printing and images on them are generally complex and expensive. For example, they may include a printing system, a coating system and a die-cutting system all connected to automatically perform these operations in sequence. Those conventional systems that are less complex and/or less expensive only cut one sheet of material at a time, and are therefore very labor intensive. To satisfy the needs of smaller print shops, a low-cost system that can automate the feed-on and feed-off operations to minimize labor overhead is required.

SUMMARY

There is provided a media loading and unloading system for use with a media cutting system having a cutting table and cutting apparatus to cut or score media held on a surface of the cutting table. The media loading and unloading system comprises an elevator assembly and a bi-directional transport system. The elevator assembly is disposed laterally adjacent one side of the cutting system table and includes a drive and multiple vertically displaced bins that are vertically movable up and down by the drive. In one embodiment, the bins include at least a lower bin and an upper bin, with the lower bin defining an in-feed tray for holding media to be fed to the cutting table surface and the upper bin defining an out-feed tray for holding media removed from the cutting table surface. The bi-directional transport system transports media in a lateral feed direction from the elevator assembly to the cutting table surface and removes media from the cutting table surface in a lateral direction opposite to the feed direction to the elevator assembly.

The transport system comprises a pair of rails extending from the elevator assembly over the cutting system table and a sheet acquisition system is movably mounted to the rails.

The sheet acquisition system may be a vacuum system having at least one vacuum cup or port.

The out-feed tray may be offset in the lateral direction from the in-feed tray.

The media loading and unloading system may further comprise a controller adapted to communicate with a controller of the cutting system.

The media loading and unloading system may further comprise a stack height sensor assembly for detecting the height of the media in the in-feed tray and the out-feed tray.

The stack height sensor assembly may comprise a pivotally mounted sensor arm, a sensor and a solenoid. The sensor arm may include a media contact segment and a flag segment, where the sensor arm is pivotally mounted at a position intermediate the media contact segment and the flag segment whereby the media contact segment is pivotally moveable into and out of the elevator assembly.

An inner side of the upper bin may be positioned laterally outward to an inner side of the lower bin.

The upper and lower bin may each define a plane that extends laterally outward and vertically downward.

There is also provided a method of loading and unloading media from a surface of a cutting table of a cutting system using a media loading and unloading system including an elevator assembly disposed laterally adjacent one side of the cutting table, and a bi-directional transport system. The elevator assembly includes a drive and multiple vertically displaced bins that are vertically movable up and down by the drive. The bins include at least a lower bin and an upper bin, with the lower bin defining an in-feed tray for holding media to be fed to the cutting table surface, the upper bin defining an out-feed tray for holding media removed from the cutting table surface. The method comprises a) positioning the in-feed tray at a feeding height with the drive; b) acquiring a sheet of the media from the in-feed tray with the transport system; c) transporting the sheet of media in a lateral feed direction from the in-feed tray to the cutting table with the transport system; d) releasing the sheet of media from the transport system onto the surface of the cutting table; e) positioning the out-feed tray at a stacking height with the drive; f) acquiring the sheet of the media from the surface of the cutting table with the transport system after completion of cutting system operation; g) transporting the sheet of media in a direction opposite to the lateral feed direction from the cutting table to the out-feed tray with the transport system; and h) releasing the sheet of media from the transport system into the out-feed tray.

The transport system includes a pair of rails extending from the elevator assembly over the cutting table and a sheet acquisition system movably mounted to the rails. Acquiring the sheet of the media from the in-feed tray comprises positioning the sheet acquisition system over a leading edge of a top sheet of media in the in-feed tray and actuating the sheet acquisition system to acquire the top sheet of media.

Transporting the sheet of media in the lateral feed direction comprises driving the sheet acquisition system along the rails whereby the sheet of media is positioned over the cutting table.

Transporting the sheet of media in the direction opposite to the lateral feed direction comprises driving the sheet acquisition system along the rails whereby the sheet of media is positioned over the out-feed tray.

The method may further comprise the step of loading the in-feed tray with media.

The method may further comprise the step of querying whether or not the cutting job has been finished, and repeating steps a though h if the cutting job has not been finished.

The media loading and unloading system also includes a stack height sensor assembly including a pivotally mounted sensor arm, a sensor, and a solenoid, the sensor arm having a flag segment and a media contact segment positionable within the elevator assembly. Positioning the in-feed tray at a feeding height with the drive comprises actuating the solenoid to pivot the sensor arm whereby the sensor arm media contact segment is moved out of the elevator assembly; driving the in-feed tray upward with the drive; actuating the solenoid to pivot the sensor arm whereby the sensor arm media contact segment is moved into the elevator assembly when the in-feed tray has been driven upward a pre-determined distance; contacting an upper surface of a top sheet of media in the in-feed tray with the sensor arm media contact segment; pivoting the sensor arm as the in-feed tray is driven upward; contacting the sensor with the sensor arm flag segment when the top sheet of media in the in-feed tray is at the feeding height; and halting the drive.

The predetermined vertical distance for inserting the contact segment is at a point intermediate a bottom surface of the upper bin and a maximum allowable height for media in the in-feed tray.

Positioning the out-feed tray at a stacking height with the drive comprises actuating the solenoid to pivot the sensor arm whereby the sensor arm media contact segment is moved out of the elevator assembly; driving the out-feed tray downward with the drive; actuating the solenoid to pivot the sensor arm whereby the sensor arm media contact segment is moved into the elevator assembly when the out-feed tray has been driven downward a pre-determined distance; driving the out-feed tray upward with the drive; contacting an upper surface of a top sheet of media in the out-feed tray with the sensor arm media contact segment; pivoting the sensor arm as the out-feed tray is driven upward; contacting the sensor with the sensor arm flag segment when the top sheet of media in the out-feed tray is at the stacking height; and halting the drive.

The predetermined vertical distance for inserting the contact segment is at a point above a maximum allowable height for media in the out-feed tray.

BRIEF DESCRIPTION OF THE DRAWINGS

The present disclosure may be better understood and its numerous objects and advantages will become apparent to those skilled in the art by reference to the accompanying drawings in which.

DETAILED DESCRIPTION

With reference to the drawings wherein like numerals represent like parts throughout the several figures, an automatic media loading and unloading system in accordance with the present disclosure is generally designated by the numeral 10.

"Dimensional Document" is hereby defined to be a three-dimensional object, such as a megaphone, a box, a photo-geodome, and the like, having printed matter, such as text and images, disposed on an exterior surface.

"Media" is hereby defined to be any sheet-shaped stock, such as paper, cardboard, paper board, etc., having a surface that will receive and retain printed matter and that may be formed into a dimensional document.

Figure 1:
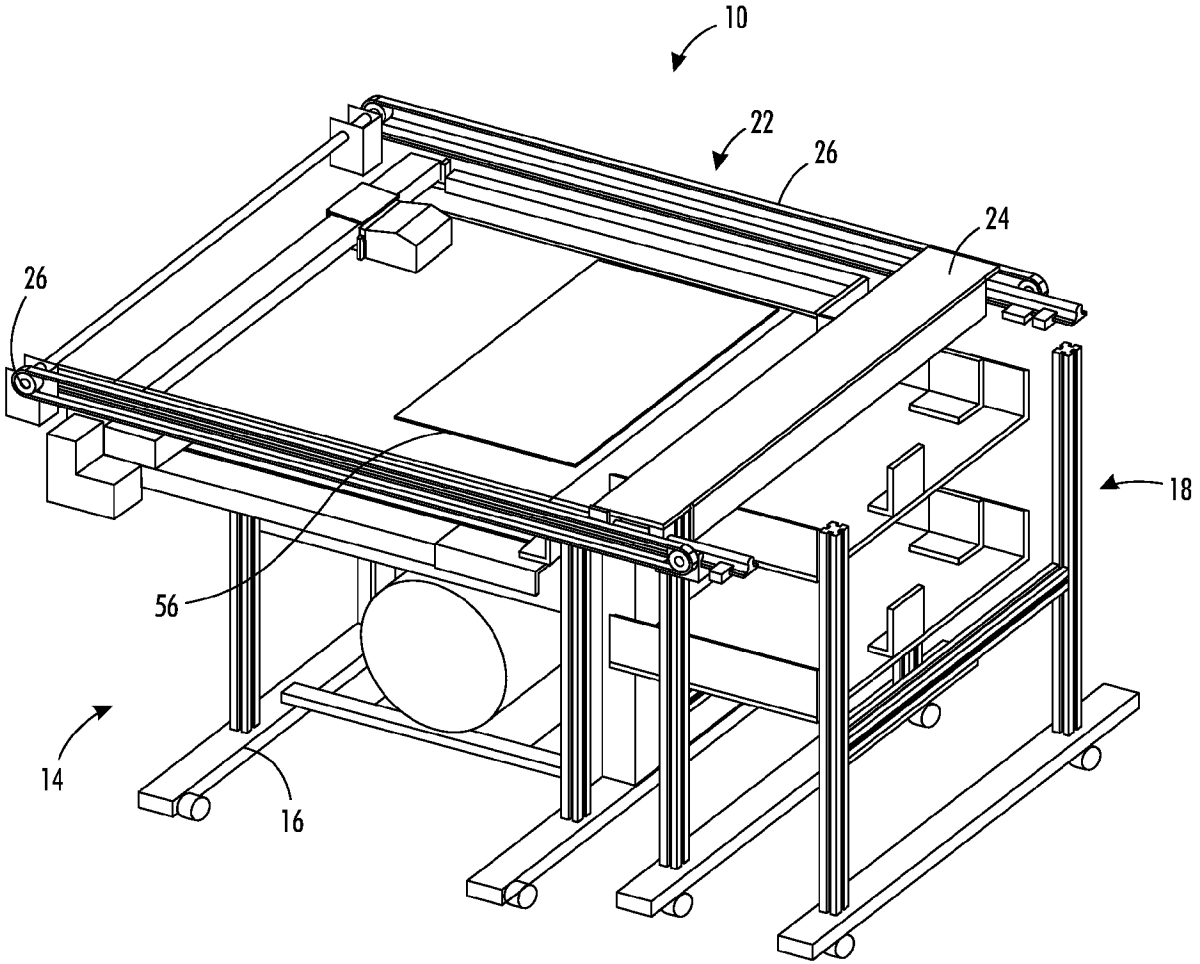
FIG. 1 is a perspective schematic partial view of a cutting system and a media loading and unloading system in accordance with the present disclosure.
Figure 2:
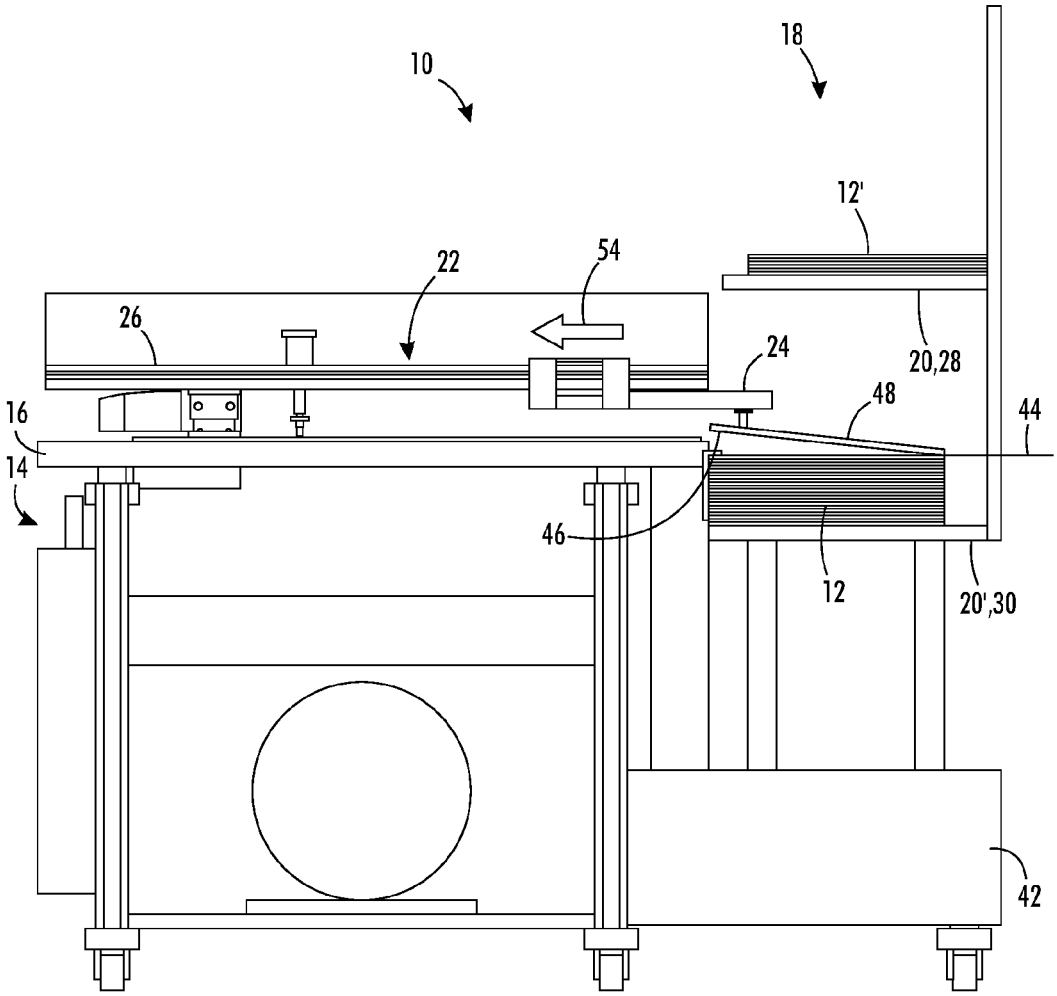
FIG. 2 is a simplified side view of the cutting system and the media loading and unloading system of FIG. 1, showing the media loading and unloading system loading media onto the cutting system.
Figure 3:
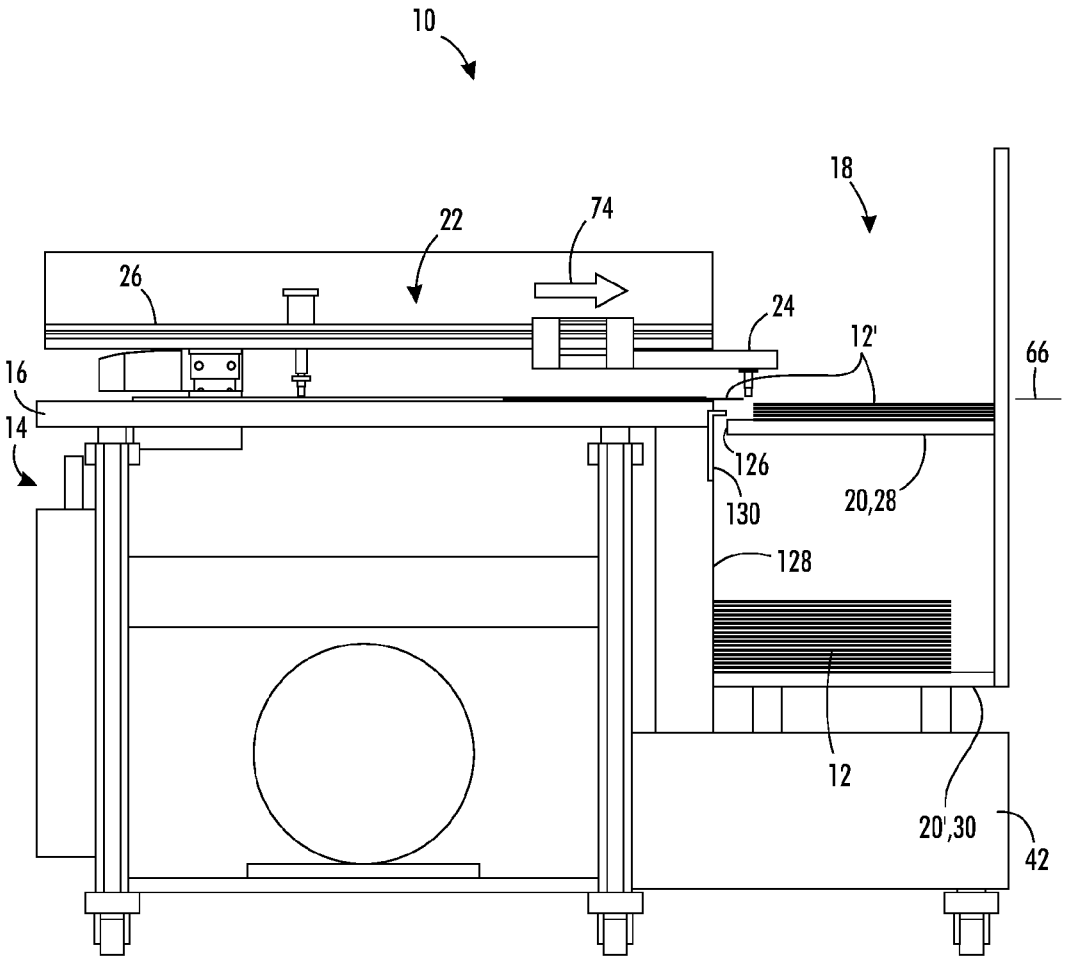
FIG. 3 is a simplified side view of the cutting system and the media loading and unloading system of FIG. 1, showing the media loading and unloading system unloading media from the cutting system.

With reference to FIGS. 1-3, the subject media loading and unloading system 10 automates the process of supplying and removing media/stock 12, 12' from cutting systems 14 for dimensional packaging applications. The system 10 adds automatic feed-on and feed-off functions to a table based cutting system 14, such as the FC2250 series cutting systems by Graphtec Corporation, capable of performing customized cutting or scoring operations on sheet media 12.

To minimize the footprint of the media loading and unloading system 10 and avoid interference with the cutting system 14, the media loading and unloading system 10 is positioned on one side of the cutting system table 16. This is accomplished through the use of an elevator assembly 18 having multiple vertically displaced bins 20, 20' positioned next to the cutting table 16. A transport system 22 includes a sheet acquisition system 24 that is movably mounted to a pair of rails 26 that extend from the elevator assembly 18 over the cutting system table 16. To facilitate understanding of the subject system 10 and method, the multi-bin elevator assembly 18 described below includes only a single upper bin 20, which functions as an out-feed or stacking tray 28, and a single lower bin 20', which functions as an in-feed tray 30, where out-feed tray is hereby defined to be a tray in which media is deposited after processing and in-feed tray is hereby defined to be a tray from which media is taken for processing. It should be appreciated that the multi-bin elevator assembly 18 may include additional bins 20, 20' acting as in-feed trays and/or out-feed trays. For example, the elevator assembly 18 may include two in-feed trays 30 having different paper stocks, and/or two out-feed trays 28 for stacking two different jobs or to increase system stacking capacity.

Figure 4:
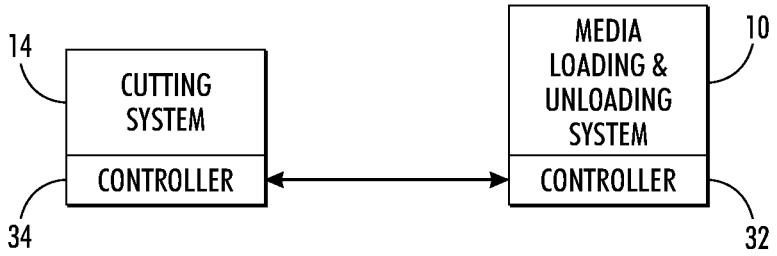
FIG. 4 is a simplified schematic view of the cutting system and the media loading and unloading system of FIG. 1.
Figure 5:
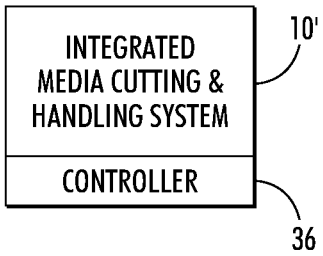
FIG. 5 is a simplified schematic view of an alternate embodiment of the cutting system and the media loading and unloading system of FIG. 1.

With reference to FIG. 4, the media loading and unloading system 10 may be a modular system that cooperates with a separate cutting system 14. In this case, the system controller 32 of the media loading and unloading system 10 may communicate with the controller 34 for the cutting system 14 such that operation of the media loading and unloading system 10 is coordinated with operation of the cutting system 14 as described below. Alternatively, the media loading and unloading system may be integrated with the cutting system 14 into a single coordinated system 10' (FIG. 5) having a single controller 36.

Figure 6:
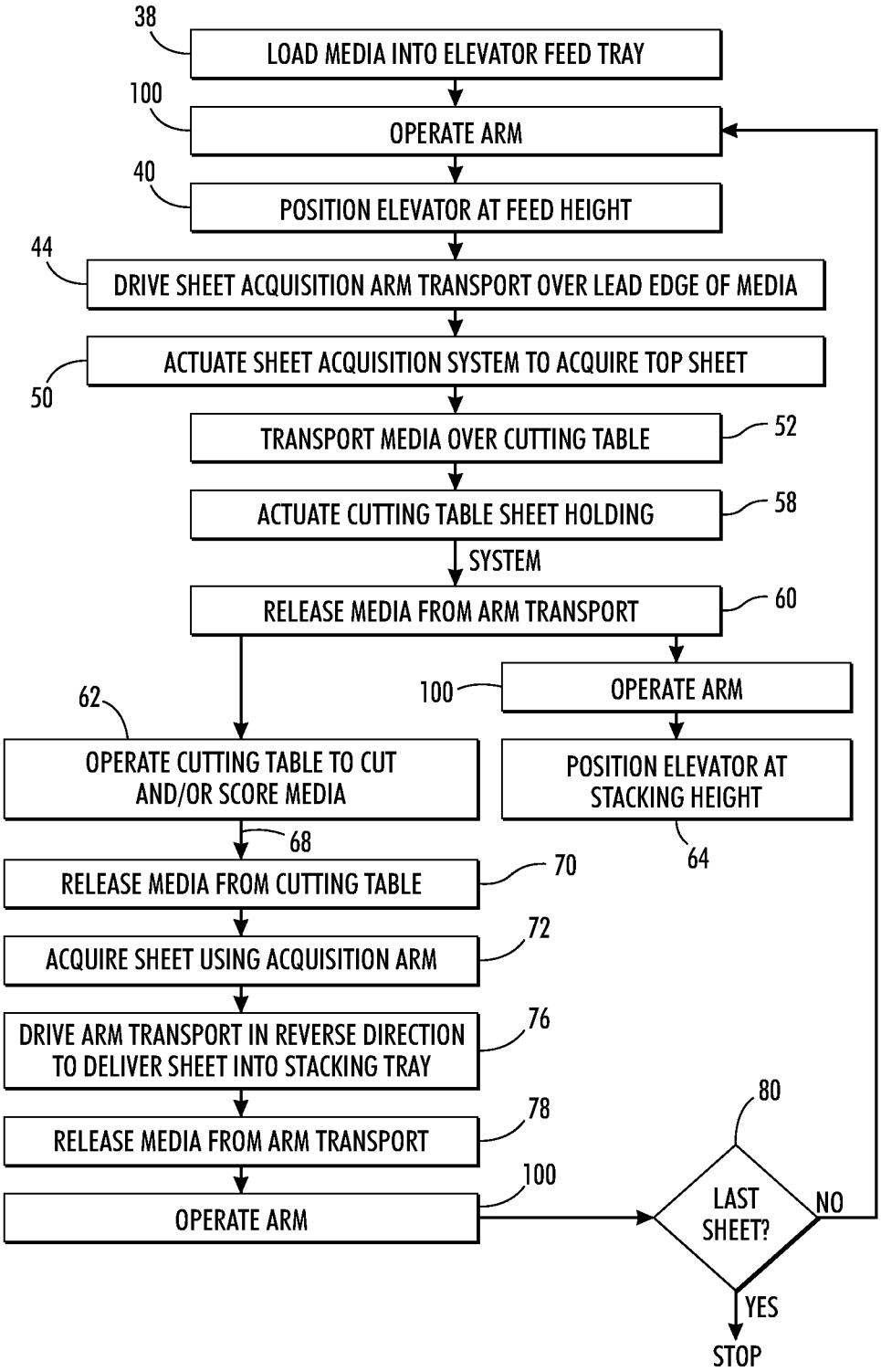
FIG. 6 is a flow diagram of a method of loading and unloading a cutting system in accordance with the disclosure.
Figure 7:
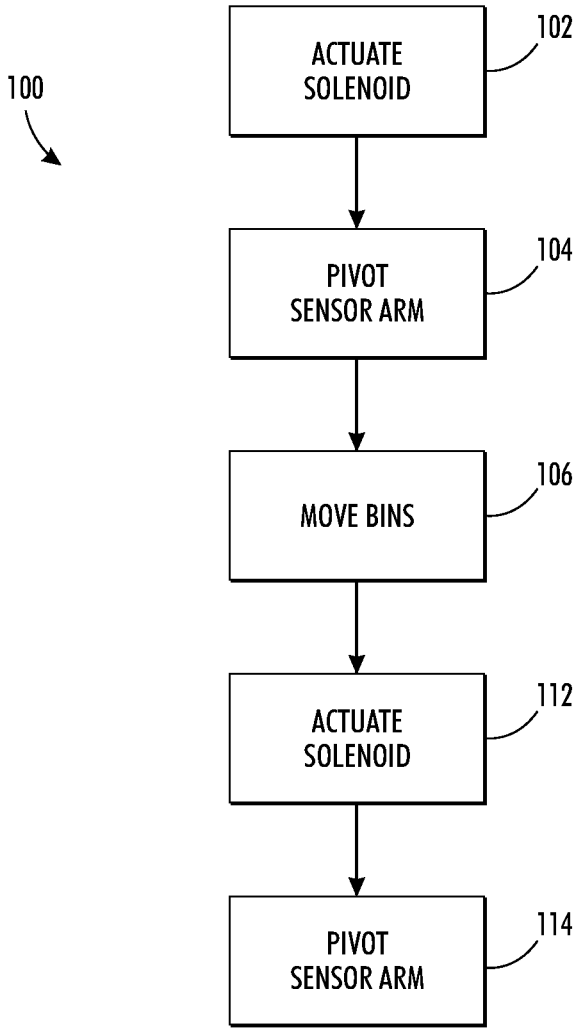
FIG. 7 is a flow diagram of the operate arm steps of FIG. 6.

With additional reference to FIG. 6, the media 12 to be fed to the table 16 is loaded 38 into the lower elevator bin 20'/in-feed tray 30, and the lower bin 20' is positioned 40 by an elevator drive 42 such that the media 12 in the in-feed tray 30 is at the feed height 44. A sheet acquisition system 24, such as a vacuum system having one or more vacuum cups or ports, mounted onto slide rails 26 is driven 44 over the lead edge 46 of the top sheet 48 of media 12 in the in-feed tray 30 and the sheet acquisition system 24 is actuated 50 to acquire the media 12. The sheet acquisition system 24 is then driven to transport 52 the media 12 in a lateral feed direction 54 such that the media 12 is positioned over the cutting table 16. The cutting system table sheet holding system 56 (for example via vacuum holes on the cutting table 16 or through electrostatic attraction) is actuated 58, and the media is released 60 by the sheet acquisition system 24 such that the cutting system 14 can gain control of the media 12.

As the cutting system 14 operates 62 to cut and/or score the media 12, the upper elevator bin 20/out-feed tray 28 is lowered such that it is positioned 64 at a stacking height 66. After cutting/scoring of the media has been completed 68, the cutting system table sheet holding system is actuated to release 70 the media 12', the sheet acquisition system 24 reacquires 72 the media 12' and the sheet acquisition system 24 is then driven in a lateral direction 74 opposite to the feed direction 54 to transport 76 the media 12 over the upper elevator bin 20. The media 12' is released 78 by the sheet acquisition system 24 such that the media 12' is deposited onto the out-feed tray 28. The system controller 32 then queries 80 whether or not the job has been finished. If not 82, the media 12 in the in-feed tray 30 is positioned 40 at the feed height 44 and the cycle repeats as shown in FIG. 6.

The media loading and unloading system 10 may include a stack height sensor assembly that senses the height of the media 12, 12' stored in the in-feed trays 30 and out-feed trays 28 to facilitate positioning the in-feed trays 30 at the feed height 44 and positioning the out-feed trays 28 at the stacking height 66.

In a first embodiment, FIGS. 7-9*e*, the sensor assembly 84 includes a pivotally mounted sensor arm 86, a sensor 88 and a solenoid 90. The sensor arm 86 includes a media contact segment 92 and a flag segment 94, with the sensor arm 86 being pivotally mounted to a frame (not shown) at a position 98 intermediate the media contact segment 92 and the flag segment 94 such that the media contact segment 92 may be operated 100 to pivotally move into or out of the elevator assembly 18, as explained below.

Figure 8A:
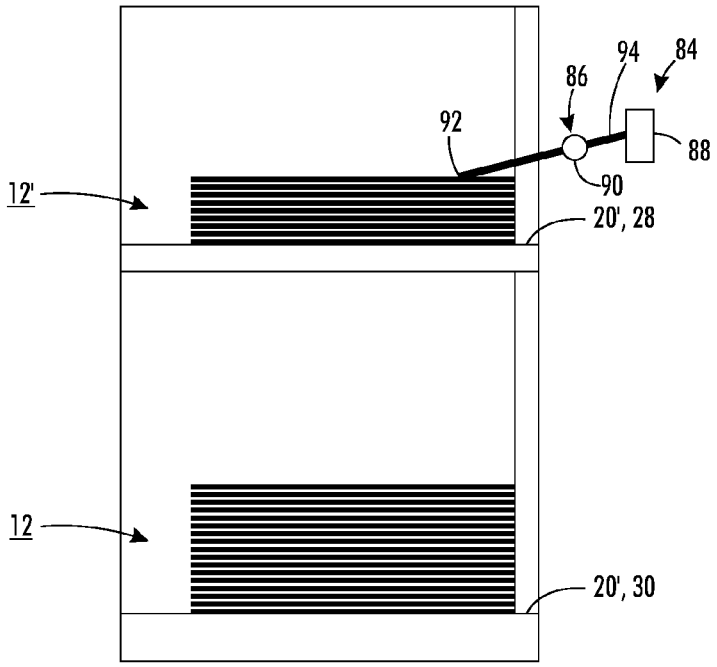
FIGS. 8A-8F are simplified schematic views showing operation of a first embodiment of a sensor assembly and the elevator system of FIG. 2 while loading media onto the cutting system.
Figure 8B:
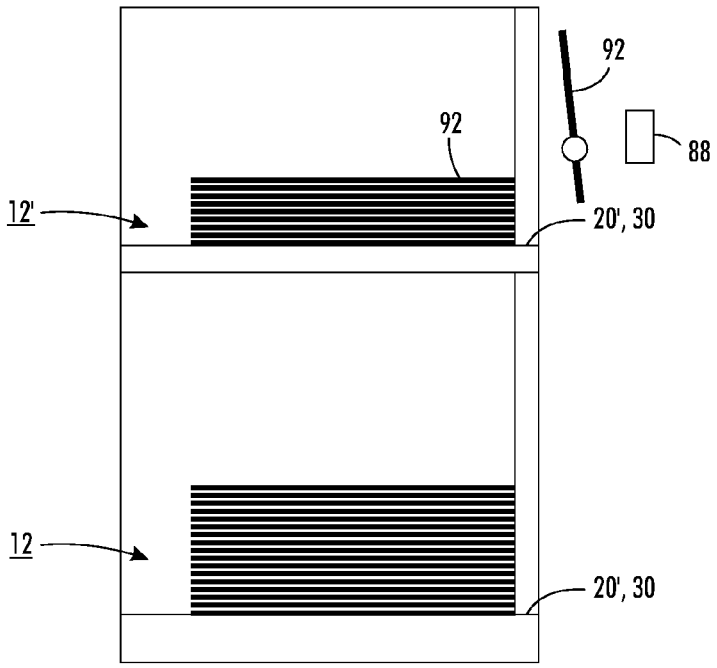

Before the elevator bins 20, 20' are repositioned in steps 40 and 64 above, the solenoid 90 is actuated 102 by the controller 32 to pivot 104 the sensor arm 86 such that the sensor arm media contact segment 92 is moved out of the elevator assembly 18, as shown in FIG. 8B. This ensures that the sensor arm media contact segment 92 does not interfere with movement of the bins 20, 20' or their contents and/or movement of the bins 20, 20' does not damage the sensor arm media contact segment 92. After the bins 20, 20' of the elevator assembly 18 have moved 106 a predetermined vertical distance 108, 110, the solenoid 90 is actuated 112 by the controller 37 to pivot 114 the sensor arm 86 such that the sensor arm media contact segment 92 is moved into the elevator assembly 18'.

Figure 8C:
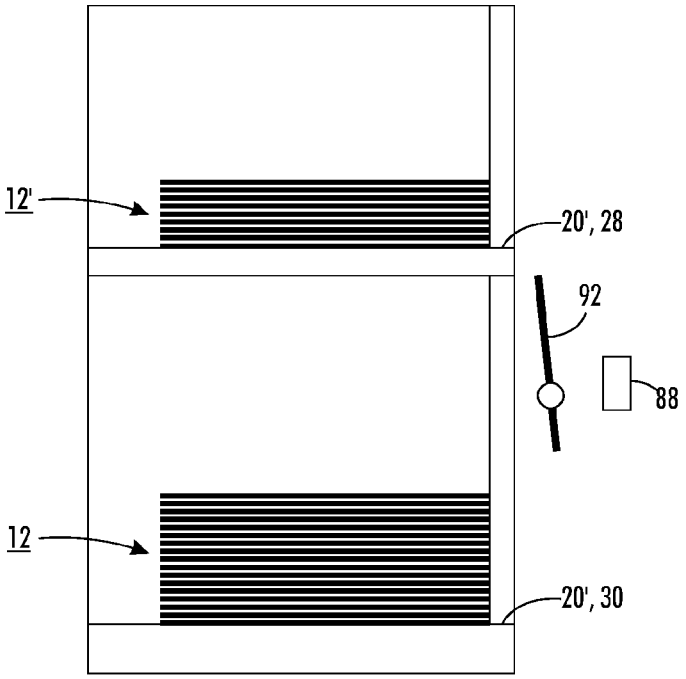
Figure 8D:
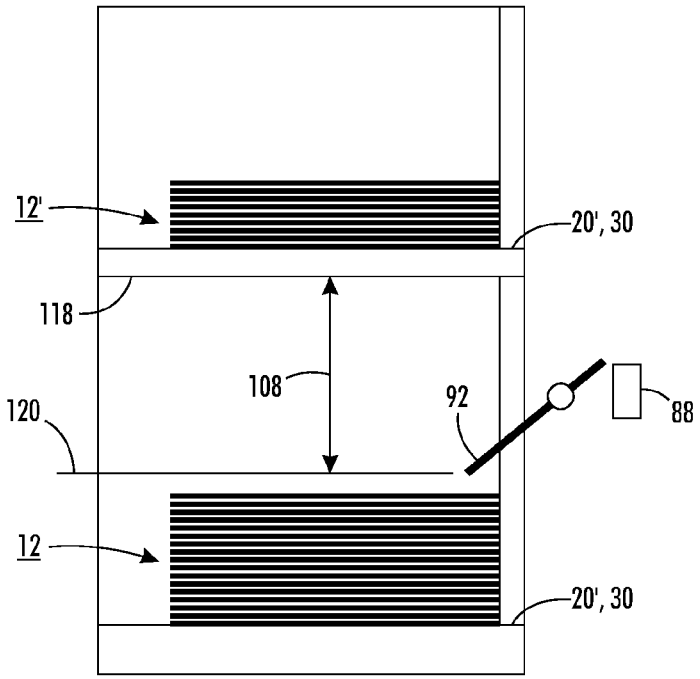
Figure 8E:
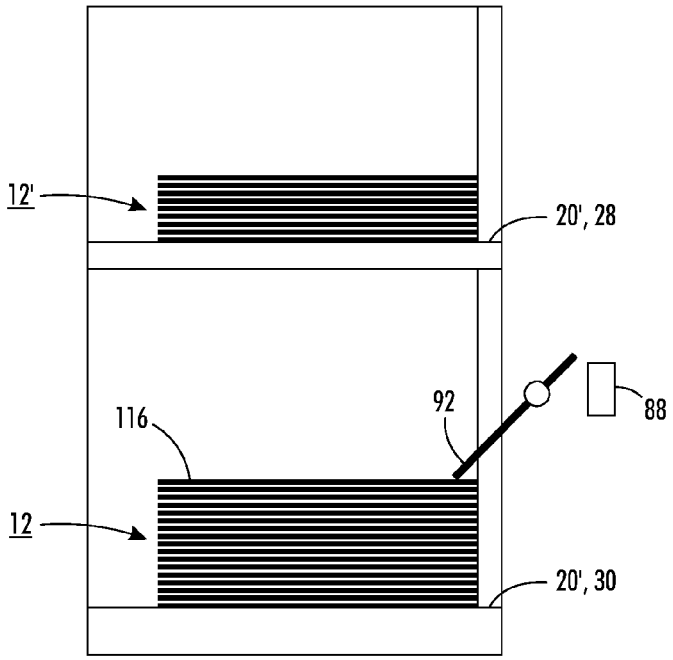
Figure 8F:
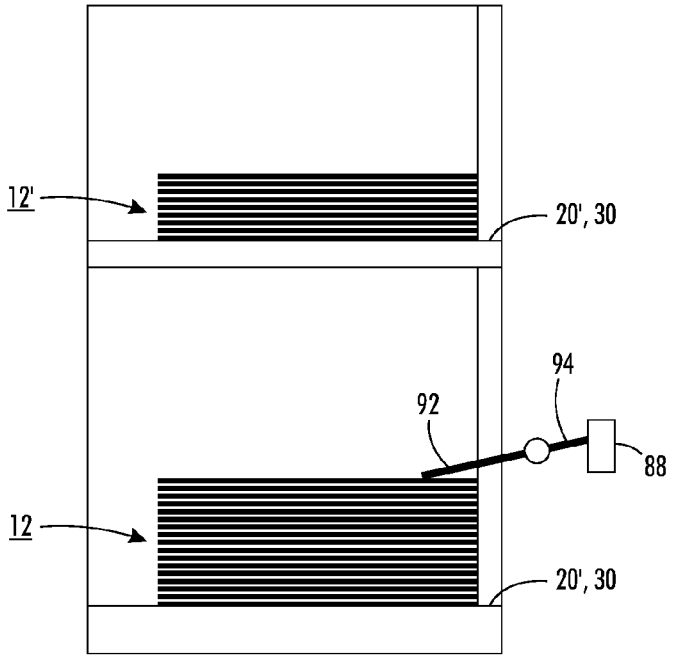

In the example of step 40, when the elevator bins 20, 20' are being positioned to feed media 12 from the in-feed tray 30, the bins 20, 20' move upward to position the in-feed tray 30 at the feed height 44. With additional reference to FIGS. 8*a*-8*f*, the sensor arm media contact segment 92 must be removed from within the elevator assembly 18 to prevent inadvertent contact between the contact segment 92 and the out-feed tray 28. FIG. 8*c* shows the out-feed tray 28 positioned at the stacking height 66, with the sensor media contact segment 62 in contact with the media 12' in the out-feed tray 28'. The sensor arm 86 is pivoted such that the media contact segment 92 is removed from the elevator assembly 18 (FIG. 8*b*), the elevator bins 20, 20' are driven upward (FIG. 8*c*), the media contact segment is inserted into the elevator assembly 18 before the in-feed tray 30 has ascended to the point where contact segment 92 can contact the in-feed tray 30 or its contents 12 (FIG. 8*d*), as the bins 20, 20' continue to ascend, the media contact segment 92 contacts the upper surface 116 of the top sheet of media 12 in the in-feed tray 30 (FIG. 8*e*) causing the sensor arm 86 to pivot. When the top sheet of media 12 in the in-feed tray 30 is at the feed height 44, the sensor arm flag segment 94 blocks the sensor 88, the sensor 88 sends a signal to the controller 32, which halts movement of the bins 20, 20' (FIG. 8*f*). Accordingly, the predetermined vertical distance 108 for inserting the media contact 92 segment during step 40 is at a point intermediate the bottom surface 118 of the upper bin 20 and the maximum allowable height 120 for media 12 in the in-feed tray 30 (FIG. 8*d*).

Figure 9A:
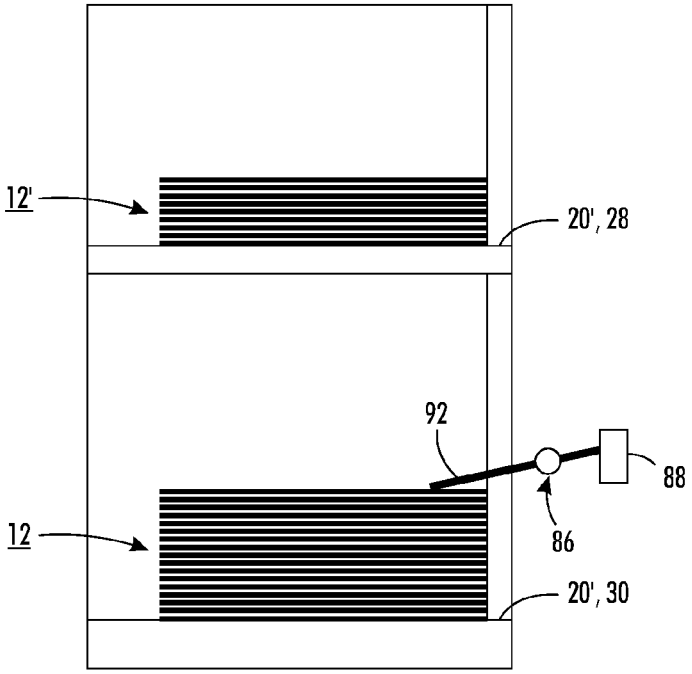
FIGS. 9A-9E are simplified schematic views showing operation of the sensor assembly of FIGS. 8A-8F and the elevator system of FIG. 3 while unloading media from the cutting system.
Figure 9B:
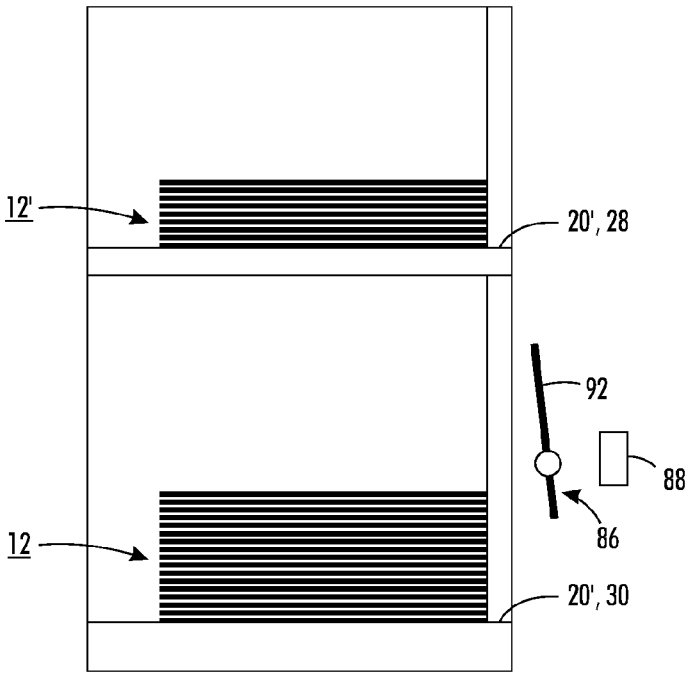
Figure 9C:
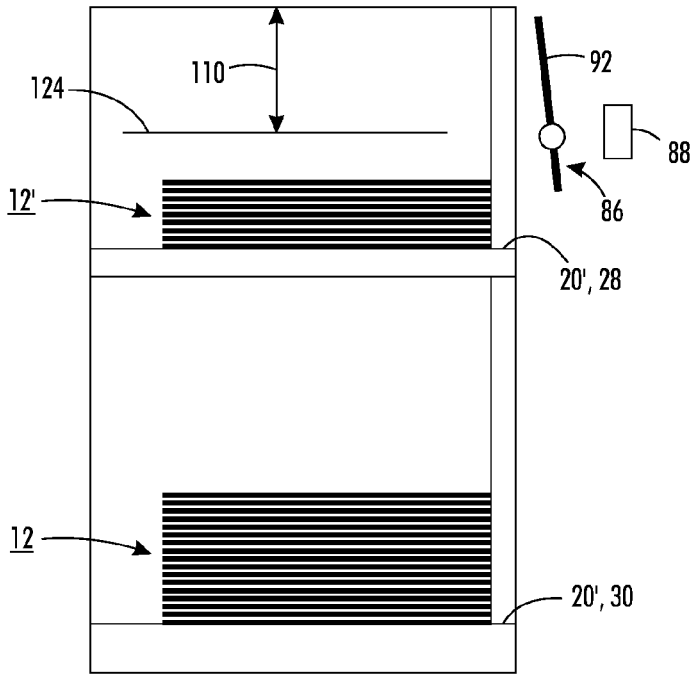
Figure 9D:
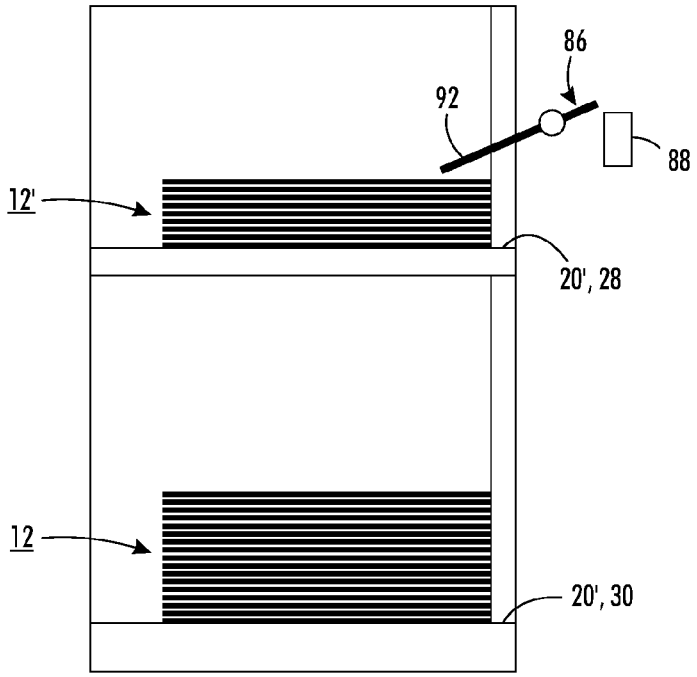
Figure 9E:
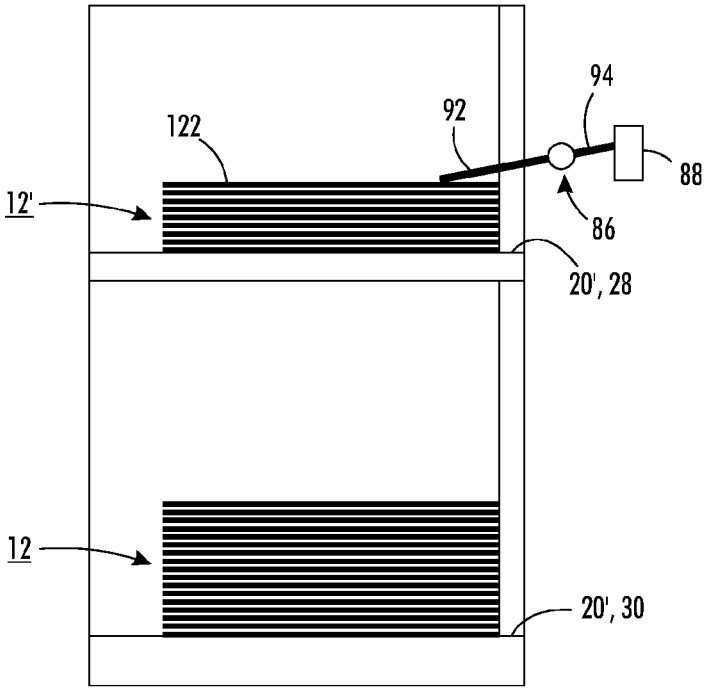

In the example of step 64, when the elevator bins 20, 20' are being positioned to remove media 12' from the cutting system table 16 to the out-feed tray 28, the bins move downward to position the out-feed tray 28 at the stacking height 66. With reference to FIGS. 9*a*-9*e*, the sensor arm media contact segment 92 must be removed from within the elevator assembly 18 to prevent inadvertent contact between the contact segment 92 and the out-feed tray 28 and the media 12' in the out-feed tray 28. FIG. 9*a* shows the in-feed tray 30 positioned at the feed height 44, with the sensor media contact segment 92 in contact with the media 12 in the in-feed tray 30. The sensor arm 86 is pivoted such that the media contact segment 92 is removed from the elevator assembly 18 (FIG. 9*b*), the elevator bins 20, 20' are driven downward (FIG. 9*c*), and the media contact segment 92 is inserted into the elevator assembly 18 after the out-feed tray 28 has descended to the point where contact segment 92 can not contact the out-feed tray 28 or its contents 12' (FIG. 9*d*). After the contact segment 92 has been inserted into the elevator assembly 18, the bins 20, 20' must be elevated until the contact segment 92 contacts with the upper surface 122 of the top sheet of media 12' in the out-feed tray 28, causing the sensor arm 86 to pivot. When the top sheet of media 12' in the out-feed tray is at the stacking height 66, the sensor arm flag segment 94 blocks the sensor 88, the sensor 88 sends a signal to the controller 32, which halts movement of the bins 20, 20' (FIG. 9*e*). Therefore, the predetermined vertical distance 110 for inserting the contact segment 92 during step 64 is at a point above the maximum allowable height 124 for media 12' in the out-feed tray 28 (FIG. 9*c*).

Figure 11A:
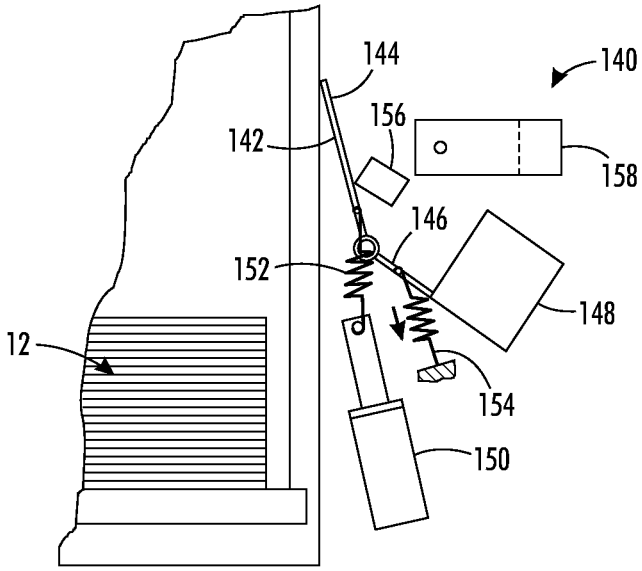
FIGS. 11A-11D are simplified schematic views showing operation of a second embodiment of a sensor assembly and the elevator system of FIG. 2 while loading media onto the cutting system.
Figure 11B:
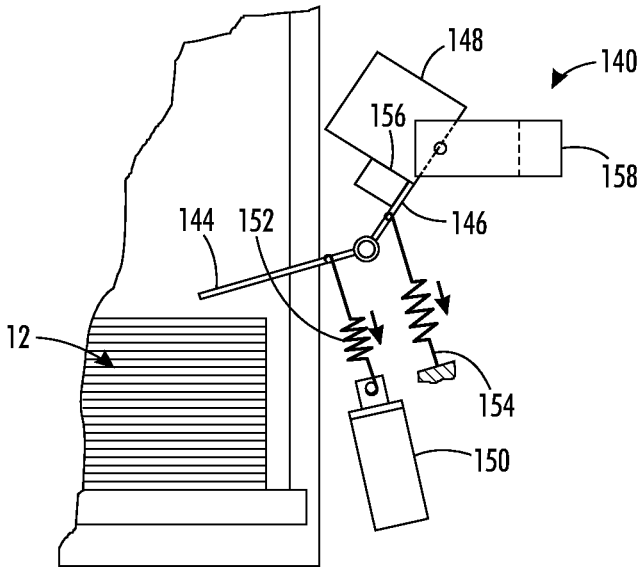
Figure 11C:
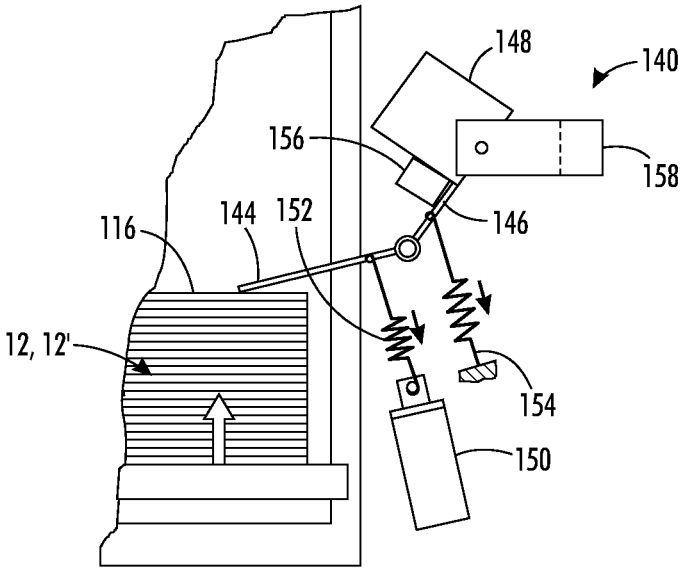
Figure 11D:
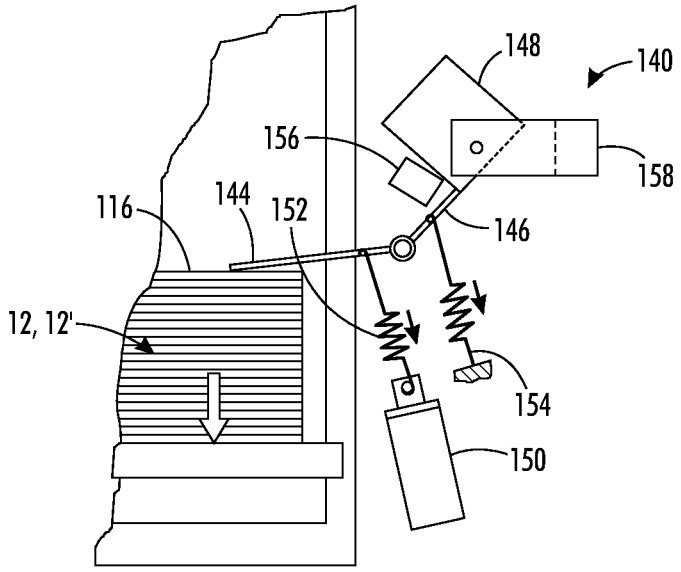
Figure 12:
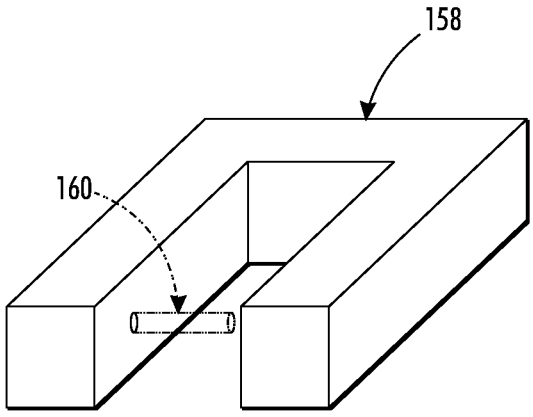
FIG. 12 is a simplified schematic view of the sensor of FIGS. 11A-11D.

In a second embodiment, FIGS. 11-12, the stack height sensor assembly 140 includes a sensor arm 142 having a media contact segment 144 and a flag segment 146, the sensor arm 142 being pivotally mounted at a position intermediate the media contact segment 144 and the flag segment 146. A sensor flag 148 extends from the sensor arm flag segment 146. A solenoid 150 having a spring 152 is connected to the sensor arm media contact segment 144 and a return spring 154 is connected to the sensor arm flag segment 146. A hard stop 156 and a sensor 158 are disposed above the sensor arm 142.

Before the elevator bins 20, 20' are repositioned, the sensor arm media contact segment 144 is withdrawn from the elevator assembly 18 by deactivating the solenoid 150, whereby the return spring 154 pulls the sensor arm flag segment 146 downward, pivoting the sensor arm media contact segment 144 upward until it contacts the hard stop 156 (FIG. 11A). After the bins 20, 20' of the elevator assembly 18 have moved 106 the predetermined distance 108, 110, the solenoid 150 is actuated, whereby the solenoid 150 pulls the sensor arm media contact segment 144 downward into the elevator assembly 18, pivoting the sensor arm flag segment 146 upward against the force exerted by the return spring 154, until the sensor arm flag segment 146 contacts the hard stop 156 (FIG. 11B). The elevator bins 20, 20' are then driven upward, whereby the sensor arm media contact segment 144 contacts the upper surface 116 of the top sheet of media 12, 12' pivoting the sensor arm media contact segment 144 upward and the sensor arm flag segment 146 downward until the sensor beam 160 (FIG. 12) detects the sensor flag 148, tripping the sensor 158. The sensor 158 then sends a signal to the controller 32, which halts movement of the bins 20, 20' (FIG. 11C). Should the bins 20, 20' be driven too far upward, such that the sensor flag 148 pass through the center line of the sensor beam 160 (FIG. 11D), the sensor 158 sends a signal to the controller 32 which drives the bins 20, 20' downward until the sensor trip point is reached.

In one variation of the elevator system, the inner side 126 of the upper bin 20 is positioned laterally outward to the inner side 128 of the lower bin 20' (FIG. 3). This arrangement provides improved access of the acquisition system 24 to the media 12 in the in-feed tray 30. This improved access allows the upper and lower bins 20, 20' to be positioned closer together vertically, if desired. The out-feed tray 28 may be moved inward into the gap 130 to facilitate loading the in-feed tray 30.

Figure 10:
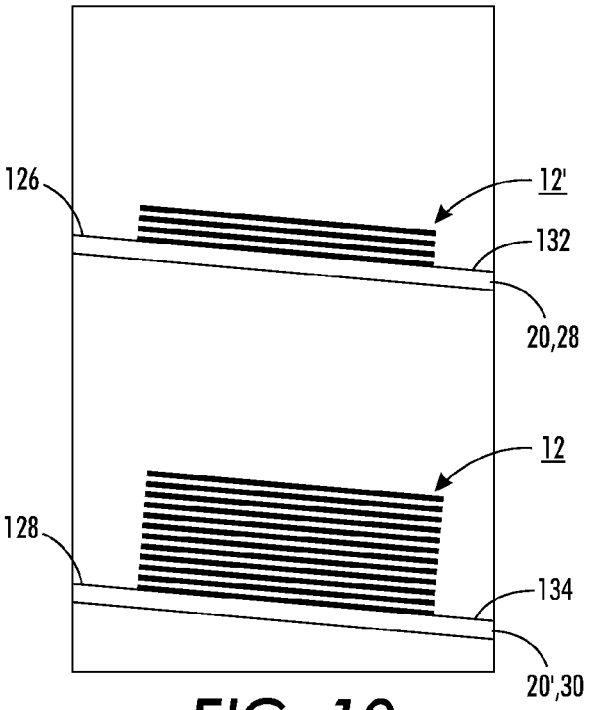
FIG. 10 is a simplified schematic view of a variation of the elevator system of FIG. 1.

In another variation of the elevator system (FIG. 10), the bins 20, 20' are tilted with the outer sides 132, 134 of the bins 20, 20' being lower than the inner sides 126, 128 of the bins 20, 20'. This variation allows for droop of the media 12, 12', where the portion of the media 12, 12' farthest from the cutting system table 16 droops downward relative to the portion of the media 12, 12' that is engaged by the acquisition system 24, which is closest to the cutting system table 16.

This arrangement of same side load & unload and multi-bin 20, 20' feed and stacking elevator 18 provide a very low cost and modular system 10 that can interface with existing cutting systems 14. As noted above, performing the media feed on and off operations on the same side of the cutting/scoring table 16 minimizes the overall footprint of the system and avoids interference issues with the cutting table carriage. Also, by utilizing an elevator system 18 to position the in-feed and out-feed trays 30, 28 at a position adjacent to the table 16, the lateral media transport system 22 can be made very simple and reliable. This approach also allows a single elevator drive system 42 and a single stack height measurement system to correctly position both the in-feed and out-feed trays 30, 28 at the appropriate height for the feeding and stacking operations respectively, even when larger stacks of media 12, 12' are to be processed.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A media loading and unloading system adapted to be used with a media cutting system having a cutting table and cutting apparatus to cut or score media held on a surface of the cutting table, the media loading and unloading system comprising:

an elevator assembly adapted to be disposed laterally adjacent one side of the cutting system table, the elevator assembly including a drive and a plurality of vertically displaced bins that are vertically movable up and down by the drive, the bins including at least a lower bin and an upper bin, one of the upper bin or the lower bin defining an in-feed tray adapted to hold media to be fed to the cutting table surface and another of the upper bin or the lower bin defining an out-feed tray adapted to hold media removed from the cutting table surface;

a stack height sensor assembly adapted to detect a height of the media in the in-feed tray and the out-feed tray; and a bidirectional transport system adapted to transport media in a lateral feed direction from the elevator assembly to the cutting table surface and remove media from the cutting table surface in a lateral direction opposite to the feed direction to the elevator assembly.

2. The media loading and unloading system of claim 1 wherein the upper bin is an in-feed tray and the lower bin is an out-feed tray.

3. The media loading and unloading system of claim 1 wherein the transport system comprises:

a pair of rails extending from the elevator assembly, the rails being adapted to extend over the cutting system table; and a sheet acquisition system is movably mounted to the rails.

4. The media loading and unloading system of claim 3 wherein the sheet acquisition system is a vacuum system having at least one vacuum cup or port.

5. The media loading and unloading system of claim 1 wherein the out-feed tray is offset in the lateral direction from the in-feed tray.

6. The media loading and unloading system of claim 1 further comprising a controller adapted to communicate with a controller of the cutting system.

7. The media loading and unloading system of claim 1 wherein the stack height sensor assembly comprises:

a pivotally mounted sensor arm;

a sensor; and a solenoid.

8. The media loading and unloading system of claim 7 wherein the sensor arm includes:

a media contact segment; and a flag segment;

wherein the sensor arm being pivotally mounted at a position intermediate the media contact segment and the flag segment whereby the media contact segment is pivotally moveable into and out of the elevator assembly.

9. The media loading and unloading system of claim 1 wherein an inner side of the upper bin is positioned laterally outward to an inner side of the lower bin.

10. The media loading and unloading system of claim 1 wherein the upper and lower bins each include a surface defining a plane that extends laterally outward and vertically downward in a direction away from the cutting table.

11. A method of loading and unloading media from a surface of a cutting table of a cutting system performing a cutting job using a media loading and unloading system including an elevator assembly disposed laterally adjacent one side of the cutting table, and a bidirectional transport system, the elevator assembly including a drive and a plurality of vertically displaced bins that are vertically movable up and down by the drive, the bins including at least one bin defining an in-feed tray adapted to hold media to be fed to the cutting table surface and at least one bin defining an out-feed tray adapted to hold media removed from the cutting table surface, the method comprising:

a) positioning the in-feed tray at a feeding height with the drive;

b) acquiring a sheet of the media from the in-feed tray with the transport system;

c) transporting the sheet of media in a lateral feed direction from the in-feed tray to the cutting table with the transport system;

d) releasing the sheet of media from the transport system onto the surface of the cutting table;

e) positioning the out-feed tray at a stacking height with the drive;

f) acquiring the sheet of the media from the surface of the cutting table with the transport system after completion of cutting system operation;

g) transporting the sheet of media in a direction opposite to the lateral feed direction from the cutting table to the out-feed tray with the transport system;

h) releasing the sheet of media from the transport system into the out-feed tray; and i) querying whether or not the cutting job has been finished, and repeating steps a though h if the cutting job has not been finished.

12. The method of claim 11 wherein the transport system includes a pair of rails extending from the elevator assembly over the cutting table and a sheet acquisition system movably mounted to the rails and acquiring the sheet of the media from the in-feed tray comprises positioning the sheet acquisition system over a leading edge of a top sheet of media in the in-feed tray; and actuating the sheet acquisition system to acquire the top sheet of media.

13. The method of claim 12 wherein transporting the sheet of media in the lateral feed direction comprises driving the sheet acquisition system along the rails whereby the sheet of media is positioned over the cutting table.

14. The method of claim 12 wherein transporting the sheet of media in the direction opposite to the lateral feed direction comprises driving the sheet acquisition system along the rails whereby the sheet of media is positioned over the out-feed tray.

15. The method of claim 11 further comprising the step of loading the in-feed tray with media.

16. A method of loading and unloading media from a surface of a cutting table of a cutting system performing a cutting job using a media loading and unloading system including an elevator assembly disposed laterally adjacent one side of the cutting table, a bidirectional transport system and a stack height sensor assembly, the elevator assembly including a drive and a plurality of vertically displaced bins that are vertically movable up and down by the drive, the bins including at least one bin defining an in-feed tray adapted to hold media to be fed to the cutting table surface and at least one bin defining an out-feed tray adapted to hold media removed from the cutting table surface, the stack height sensor assembly including a pivotally mounted sensor arm, a sensor, and a solenoid, the sensor arm having a flag segment and a media contact segment positionable within the elevator assembly, the method comprising:

a) positioning the in-feed tray at a feeding height with the drive, including actuating the solenoid to pivot the sensor arm whereby the sensor arm media contact segment is moved out of the elevator assembly, driving the in-feed tray upward with the drive, actuating the solenoid to pivot the sensor arm whereby the sensor arm media contact segment is moved into the elevator assembly when the in-feed tray has been driven upward a pre-determined distance, contacting an upper surface of a top sheet of media in the in-feed tray with the sensor arm media contact segment, pivoting the sensor arm as the in-feed tray is driven upward, contacting the sensor with the sensor arm flag segment when the top sheet of media in the in-feed tray is at the feeding height, and halting the drive;

b) acquiring a sheet of the media from the in-feed tray with the transport system;

c) transporting the sheet of media in a lateral feed direction from the in-feed tray to the cutting table with the transport system;

d) releasing the sheet of media from the transport system onto the surface of the cutting table;

e) positioning the out-feed tray at a stacking height with the drive;

f) acquiring the sheet of the media from the surface of the cutting table with the transport system after completion of cutting system operation;

g) transporting the sheet of media in a direction opposite to the lateral feed direction from the cutting table to the out-feed tray with the transport system; and h) releasing the sheet of media from the transport system into the out-feed tray.

17. The method of claim 16 wherein the predetermined vertical distance for inserting the contact segment is at a point intermediate a bottom surface of the upper bin and a maximum allowable height for media in the in-feed tray.

18. The method of claim 16 wherein positioning the out-feed tray at a stacking height with the drive comprises:

actuating the solenoid to pivot the sensor arm whereby the sensor arm media contact segment is moved out of the elevator assembly;

driving the out-feed tray downward with the drive;

actuating the solenoid to pivot the sensor arm whereby the sensor arm media contact segment is moved into the elevator assembly when the out-feed tray has been driven downward a pre-determined distance;

driving the out-feed tray upward with the drive;

contacting an upper surface of a top sheet of media in the out-feed tray with the sensor arm media contact segment;

pivoting the sensor arm as the out-feed tray is driven upward;

contacting the sensor with the sensor arm flag segment when the top sheet of media in the out-feed tray is at the stacking height; and halting the drive.

19. The method of claim 16 wherein the predetermined vertical distance for inserting the contact segment is at a point above a maximum allowable height for media in the out-feed tray.

* * * * *